US008773096B2

(12) United States Patent
Wang et al.

(10) Patent No.: US 8,773,096 B2
(45) Date of Patent: Jul. 8, 2014

(54) APPARATUSES AND METHODS RESPONSIVE TO OUTPUT VARIATIONS IN VOLTAGE REGULATORS

(75) Inventors: Shawn Wang, Shanghai (CN); Yumin Zhang, Shanghai (CN); Jeffrey G. Barrow, Tucson, AZ (US)

(73) Assignee: Integrated Device Technology, inc., San Jose, CA (US)

( * ) Notice: Subject to any disclaimer, the term of this patent is extended or adjusted under 35 U.S.C. 154(b) by 163 days.

(21) Appl. No.: 13/434,612

(22) Filed: Mar. 29, 2012

(65) Prior Publication Data

US 2013/0257402 A1 Oct. 3, 2013

(51) Int. Cl.
*G05F 1/40* (2006.01)
*G05F 1/44* (2006.01)

(52) U.S. Cl.
USPC ..... 323/280; 323/282; 323/284; 323/285; 323/274; 323/275

(58) Field of Classification Search
USPC ..... 323/280, 282, 284, 285, 274, 275
See application file for complete search history.

(56) References Cited

U.S. PATENT DOCUMENTS

| | | | | |
|---|---|---|---|---|
| 6,541,946 | B1 * | 4/2003 | Chen et al. | 323/280 |
| 7,193,399 | B2 | 3/2007 | Aikawa | |
| 7,218,168 | B1 | 5/2007 | Rahman | |
| 7,245,465 | B2 | 7/2007 | Hikita | |
| 7,737,674 | B2 | 6/2010 | Erbito, Jr. | |
| 7,957,214 | B2 | 6/2011 | Tanzawa et al. | |
| 8,129,966 | B2 * | 3/2012 | Takagi | 323/280 |
| 2006/0232327 | A1 * | 10/2006 | Takagi et al. | 327/541 |
| 2008/0218139 | A1 | 9/2008 | Takagi | |
| 2008/0238385 | A1 * | 10/2008 | Nagata et al. | 323/280 |
| 2009/0206807 | A1 | 8/2009 | Imura et al. | |
| 2010/0156364 | A1 | 6/2010 | Cho et al. | |
| 2010/0213909 | A1 | 8/2010 | Nakashimo | |
| 2011/0074370 | A1 | 3/2011 | Imura et al. | |
| 2011/0248688 | A1 | 10/2011 | Iacob et al. | |
| 2012/0013317 | A1 | 1/2012 | Morino | |

OTHER PUBLICATIONS

PCT International Search Report and Written Opinion of the International Searching Authority for PCT/US2012031283, dated Nov. 29, 2012, 8 pages.

* cited by examiner

*Primary Examiner* — Bao Q Vu
(74) *Attorney, Agent, or Firm* — TraskBritt

(57) ABSTRACT

A voltage regulator includes an amplifier to generate a difference voltage responsive to a comparison of a reference voltage and a feedback voltage. An output driver is coupled to the amplifier and drives a regulated output voltage responsive to the difference voltage. An impedance circuit is coupled between the output driver and a low power source and establishes the feedback voltage responsive to a current through the impedance circuit. A variation detector is operably coupled between the regulated output voltage and the difference voltage and is configured to modify the difference voltage. In some embodiments, the difference voltage is modified responsive to a rapid change of the regulated output voltage capacitively coupled to the variation detector. In other embodiments, the difference voltage is modified responsive to a rapid change of the feedback voltage capacitively coupled to the variation detector.

26 Claims, 5 Drawing Sheets

APPARATUSES AND METHODS RESPONSIVE TO OUTPUT VARIATIONS IN VOLTAGE REGULATORS

TECHNICAL FIELD

Embodiments of the present disclosure relate generally to voltage regulators and, more particularly, to apparatuses and methods related to controlling output variations in voltage regulators.

BACKGROUND

Voltage regulators are circuits that are used to provide a regulated voltage for use by other power consumption circuitry. For example, voltage regulators are included in many integrated circuits, for providing stable voltages at a variety of voltage levels. The requirements from the power consumption circuitry for voltage, current, or a combination thereof may vary depending on operation conditions and functional operations of the power consumption circuitry. This variable demand can cause the magnitude of the regulated voltage to vary as well. The voltage regulator, however, is supposed to adjust to the varying needs and changes so that the regulated output voltage maintains a relatively stable voltage level.

FIG. 1 illustrates a conventional voltage regulator 100 for providing a regulated output voltage 150 (Vout). The voltage regulator 100 includes a differential amplifier 110 providing a difference voltage 115 (Vdiff) based on the voltage difference between a reference voltage 105 (Vref) and a feedback voltage 145 (Vmon). The difference voltage 115 from the differential amplifier 110 is coupled to a gate of a p-channel transistor 120 that drives the regulated output voltage 150 in accordance with the output voltage of the differential amplifier 110. Resistance R1 130 and resistance R2 140 are coupled in series to the drain of the p-channel transistor 120. A combination of the resistance 130 and the resistance 140 may be used to set the voltage magnitude of the output voltage 150. In particular, for the voltage regulator 100, $Vout=(1+R2/R1)\times Vref$. The resistances R1 and R2 are also configured as a voltage divider to provide an appropriate feedback voltage 145 to the differential amplifier 110 for comparison to the reference voltage 105.

In operation, the magnitude of the output voltage 150 is monitored through a feedback loop providing the feedback voltage 145 to the differential amplifier 110. In response, the differential amplifier 110 varies the conductivity of the p-channel transistor 120 that drives the output voltage 150 in accordance with the difference between the feedback voltage 145 and the reference voltage 105. For example, when the feedback voltage 145 is less than the reference voltage 105, the differential amplifier 110 provides a voltage to the gate of the p-channel transistor 120 to be more conductive, thereby driving the output voltage 150 to a higher level. Conversely, when the feedback voltage 145 is greater than the reference voltage 105, the differential amplifier 110 provides a voltage to the gate of the p-channel transistor 120 to be less conductive, thereby driving the output voltage 150 to a lower level.

However, this feedback mechanism can react relatively slowly to rapid changes in power demands from the power consumption circuitry coupled to the output voltage 150. There is a need for methods and apparatuses for providing a stable output voltage that reacts more quickly in response to rapid changes on power requirements.

BRIEF SUMMARY

Embodiments of the present disclosure includes methods and apparatuses related to voltage regulators for providing a stable output voltage that reacts more quickly in response to rapid changes on power requirements.

Embodiments of the present disclosure include a voltage regulator, including an amplifier configured to generate a difference voltage responsive to a comparison of a reference voltage and a feedback voltage. An output driver is operably coupled to the amplifier and is configured to drive a regulated output voltage responsive to the difference voltage. An impedance circuit is operably coupled between the output driver and a low power source and is configured to establish the feedback voltage responsive to a current through the impedance circuit. A variation detector is operably coupled between the regulated output voltage and the difference voltage and is configured to modify the difference voltage responsive to a rapid change of the regulated output voltage capacitively coupled to the variation detector.

Other embodiments of the present disclosure include a method of regulating voltage. A reference voltage and a feedback voltage are compared to generate a difference voltage. A regulated output voltage is driven responsive to the difference voltage. The feedback voltage is established responsive to a current through an impedance circuit operably coupled between the regulated output voltage and a low power source. The difference voltage is modified responsive to a rapid change of the regulated output voltage by capacitively coupling the regulated output voltage to a current source for providing current to the difference voltage during the rapid change.

Other embodiments of the present disclosure include a voltage regulator, including an amplifier configured to generate a difference voltage responsive to a comparison of a reference voltage and a feedback voltage. An output driver is operably coupled to the amplifier and is configured to drive a regulated output voltage responsive to the difference voltage. An impedance circuit is operably coupled between the output driver and a low power source and is configured to establish the feedback voltage responsive to a current through the impedance circuit. A variation detector is operably coupled between the feedback voltage and the difference voltage and is configured to modify the difference voltage responsive to a rapid change of the feedback voltage capacitively coupled to the variation detector.

Still other embodiments of the present disclosure include a method of regulating voltage. A reference voltage and a feedback voltage are compared to generate a difference voltage. A regulated output voltage is driven responsive to the difference voltage. The feedback voltage is established responsive to a current through an impedance circuit operably coupled between the regulated output voltage and a low power source. The difference voltage is modified responsive to a rapid change of the feedback voltage by capacitively coupling the feedback voltage to a current source for providing current to the difference voltage during the rapid change.

DETAILED DESCRIPTION

Figure 1:
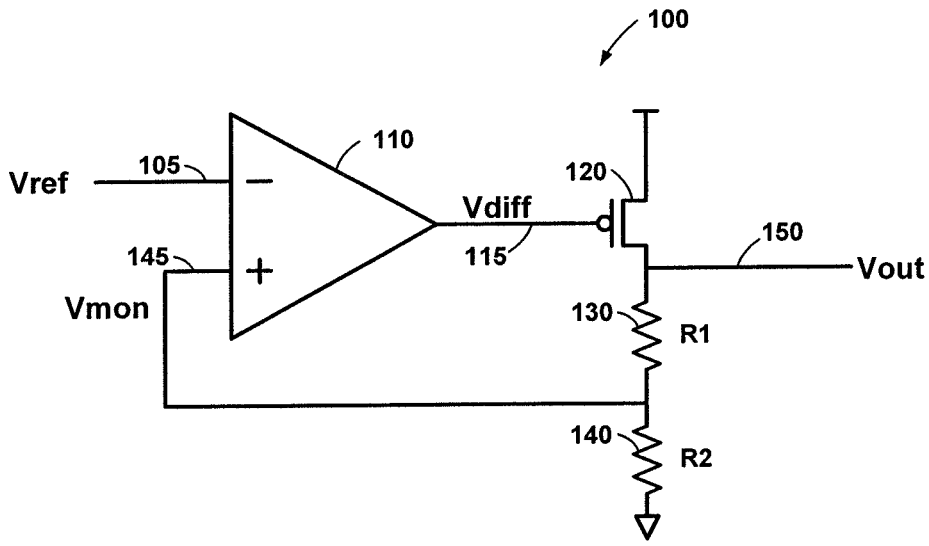
FIG. 1 (Prior Art)
FIG. 1 is a schematic diagram of a conventional voltage regulator.

In the following description, reference is made to the accompanying drawings in which is shown, by way of illustration, specific embodiments of the present disclosure. The embodiments are intended to describe aspects of the disclosure in sufficient detail to enable those skilled in the art to practice the invention. Other embodiments may be utilized and changes may be made without departing from the scope of the disclosure. The following detailed description is not to be taken in a limiting sense, and the scope of the present invention is defined only by the appended claims.

Furthermore, specific implementations shown and described are only examples and should not be construed as the only way to implement or partition the present disclosure into functional elements unless specified otherwise herein. It will be readily apparent to one of ordinary skill in the art that the various embodiments of the present disclosure may be practiced by numerous other partitioning solutions.

In the following description, elements, circuits, and functions may be shown in block diagram form in order not to obscure the present disclosure in unnecessary detail. Additionally, block definitions and partitioning of logic between various blocks is exemplary of a specific implementation. It will be readily apparent to one of ordinary skill in the art that the present disclosure may be practiced by numerous other partitioning solutions. Those of ordinary skill in the art would understand that information and signals may be represented using any of a variety of different technologies and techniques. For example, data, instructions, commands, information, signals, bits, symbols, and chips that may be referenced throughout the above description may be represented by voltages, currents, electromagnetic waves, magnetic fields or particles, optical fields or particles, or any combination thereof. Some drawings may illustrate signals as a single signal for clarity of presentation and description. It will be understood by a person of ordinary skill in the art that the signal may represent a bus of signals, wherein the bus may have a variety of bit widths and the present disclosure may be implemented on any number of data signals including a single data signal.

The various illustrative logical blocks, modules, and circuits described in connection with the embodiments disclosed herein may be implemented or performed with a general-purpose processor, a special-purpose processor, a Digital Signal Processor (DSP), an Application Specific Integrated Circuit (ASIC), a Field Programmable Gate Array (FPGA) or other programmable logic device, discrete gate or transistor logic, discrete hardware components, or any combination thereof designed to perform the functions described herein. A general-purpose processor may be a microprocessor, but in the alternative, the processor may be any conventional processor, controller, microcontroller, or state machine. A general-purpose processor may be considered a special-purpose processor while the general-purpose processor is configured to execute instructions (e.g., software code) stored on a computer-readable medium. A processor may also be implemented as a combination of computing devices, such as a combination of a DSP and a microprocessor, a plurality of microprocessors, one or more microprocessors in conjunction with a DSP core, or any other such configuration.

In addition, it is noted that the embodiments may be described in terms of a process that may be depicted as a flowchart, a flow diagram, a structure diagram, or a block diagram. Although a process may describe operational acts as a sequential process, many of these acts can be performed in another sequence, in parallel, or substantially concurrently. In addition, the order of the acts may be re-arranged. A process may correspond to a method, a function, a procedure, a subroutine, a subprogram, etc. Furthermore, the methods disclosed herein may be implemented in hardware, software, or both. If implemented in software, the functions may be stored or transmitted as one or more instructions or code on computer readable media. Computer-readable media includes both computer storage media and communication media, including any medium that facilitates transfer of a computer program from one place to another.

Figure 3:
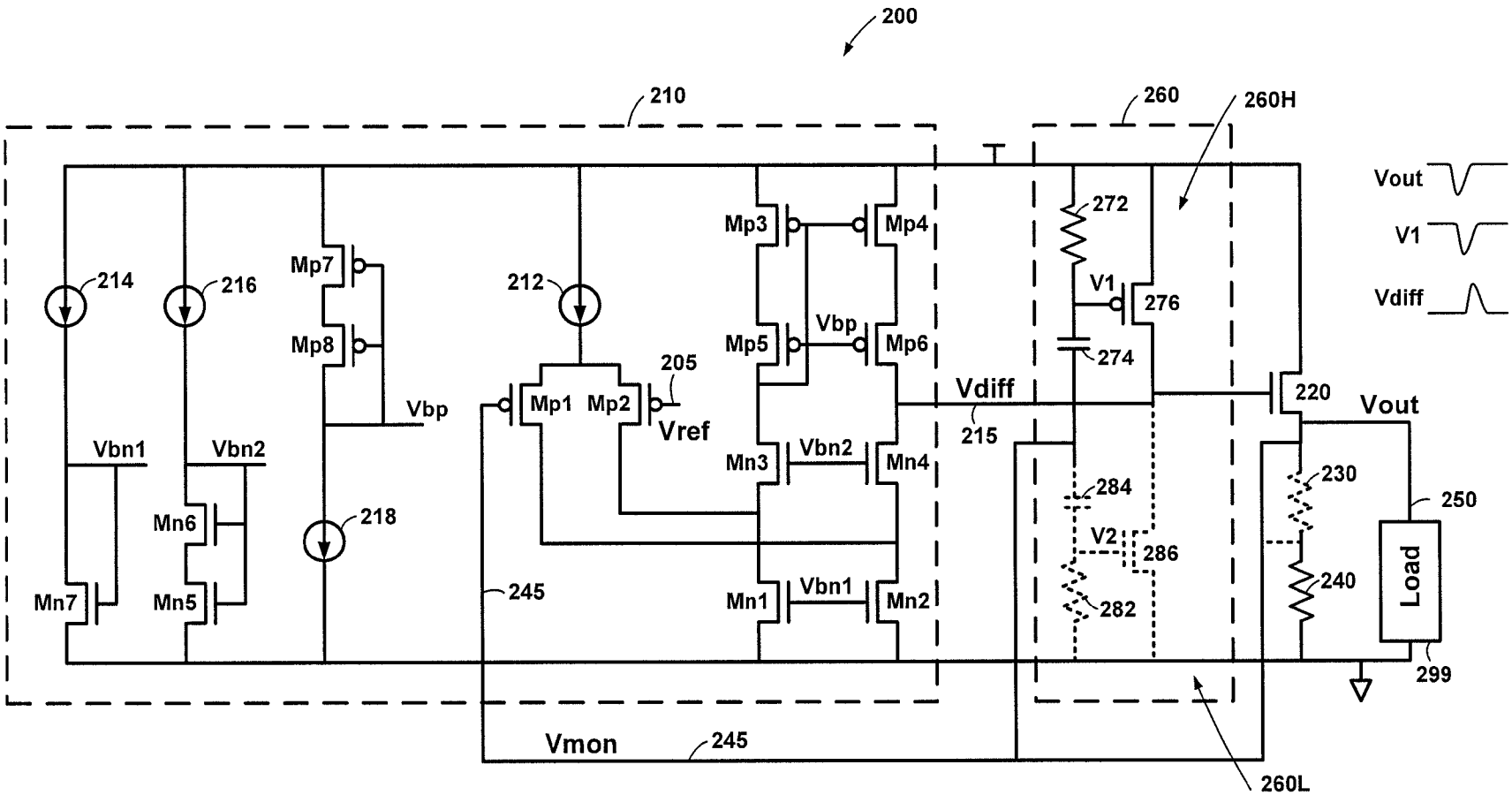
FIG. 3 is a schematic diagram of the voltage regulator of FIG. 2 showing details for an amplifier and a variation detector, along with graphs showing responses to a rapid change on a regulated output voltage in the form of a drop in voltage.

Elements described herein may include multiple instances of the same element. These elements may be generically indicated by a numerical designator (e.g. 110) and specifically indicated by the numerical indicator followed by an alphabetic designator (e.g., 110A) or a numeric indicator preceded by a "dash" (e.g., 110-1). For ease of following the description, for the most part element number indicators begin with the number of the drawing on which the elements are introduced or most fully discussed. For example, where feasible elements in FIG. 3 are designated with a format of 3xx, where 3 indicates FIG. 3 and xx designates the unique element.

It should be understood that any reference to an element herein using a designation such as "first," "second," and so forth does not limit the quantity or order of those elements, unless such limitation is explicitly stated. Rather, these designations may be used herein as a convenient method of distinguishing between two or more elements or instances of an element. Thus, a reference to first and second elements does not mean that only two elements may be employed or that the first element must precede the second element in some manner. In addition, unless stated otherwise, a set of elements may comprise one or more elements.

Embodiments of the present disclosure includes methods and apparatuses related to voltage regulators for providing a stable output voltage that reacts more quickly in response to rapid changes on power requirements.

Figure 2:
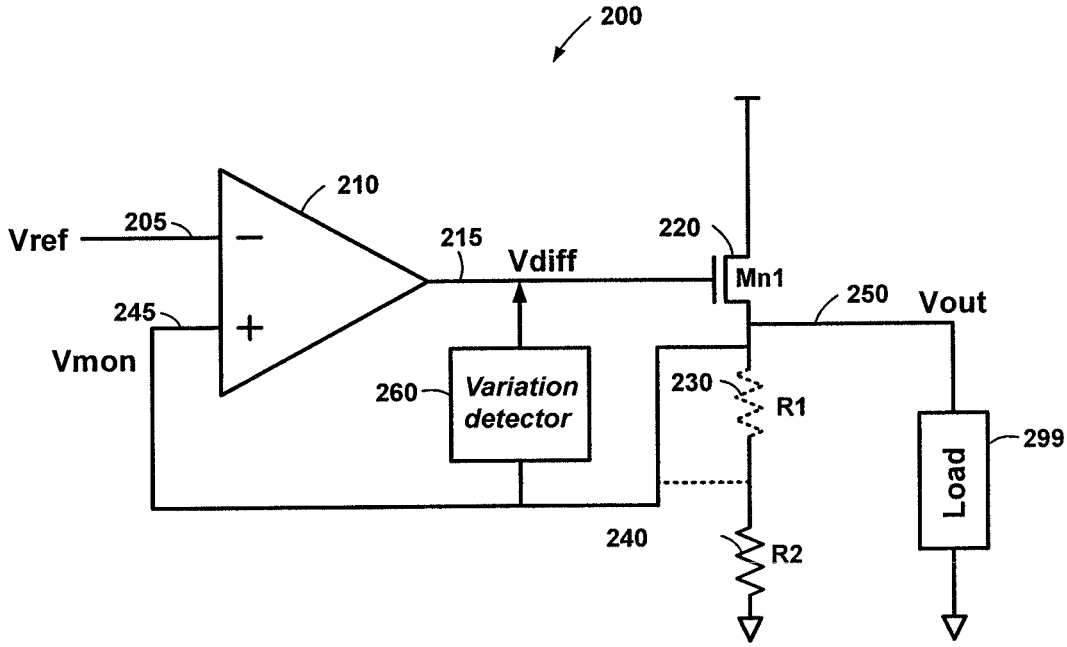
FIG. 2 is a schematic diagram of a voltage regulator according to one or more embodiments of the present disclosure.

FIG. 2 is a schematic diagram of a voltage regulator 200 according to one or more embodiments of the present disclosure. The voltage regulator 200 includes an amplifier 210 providing a difference voltage 215 (Vdiff) based on the voltage difference between a reference voltage 205 (Vref) and a feedback voltage 245 (Vmon). The difference voltage 215 from the amplifier 210 is coupled to a gate of an n-channel transistor 220 that drives a regulated output voltage 250 in accordance with the output voltage of the amplifier 210. First resistance 230 and second resistance 240 may be coupled in series to the n-channel transistor 220 to provide a current sink to set the voltage of the regulated output voltage 250 and determine a feedback voltage 245.

The amplifier 210 may be configured with a number of suitable amplifier circuits, such as, for example, an error amplifier, a differential amplifier, an operational amplifier, and an operational transconductance amplifier.

In FIG. 2, an n-channel transistor 220 is illustrated as the pull-up device providing the output current for the regulated output voltage 250. In other embodiments, a p-channel transistor, such as p-channel transistor 120 in FIG. 1 may be used as the pull-up device providing the output current for the regulated output voltage 250. In general, this pull-up device may be referred to herein as an output driver 220.

The first resistance 230 is illustrated as optional in FIG. 2. For example, if the second resistance 240 directly coupled to the output driver 220 creates a suitable voltage level for the feedback voltage 245, the first resistance 230 may be left out and the regulated output voltage 250 may couple directly to the second resistance 240 and the feedback voltage 245.

In other embodiments, a different feedback voltage 245 may be desirable in a manner similar to that of FIG. 1. In such embodiments, the first resistance 230 and the second resistance 240 may be included in series to determine the regulated output voltage 250. In addition, the first resistance 230 and the second resistance 240 may be configured as a voltage divider to determine the feedback voltage 245 separately from the regulated output voltage 250. The various combinations of the first resistance 230 and the second resistance 240 may be referred to herein as an impedance circuit.

A variation detector 260 is included in embodiments of the present disclosure. The variation detector 260 includes an input coupled to the feedback voltage 245, which may be from the voltage divider or from the regulated output voltage 250. An output from the variation detector 260 drives the difference voltage 215 in parallel with the amplifier 210. The variation detector 260 is configured to modify the difference voltage 215 responsive to a rapid change of the regulated output voltage 250.

In operation, a magnitude of the regulated output voltage 250 is monitored through an overall feedback loop providing the feedback voltage 245 to the amplifier 210. In response, the amplifier 210 varies the conductivity of the output driver 220 that drives the regulated output voltage 250 in accordance with the difference between the feedback voltage 245 and the reference voltage 205. For example, when the feedback voltage 245 is less than the reference voltage 205, the amplifier 210 provides a voltage to the output driver 220 indicating the output driver 220 should be more conductive, thereby driving the regulated output voltage 250 to a higher level. Conversely, when the feedback voltage 245 is greater than the reference voltage 205, the amplifier 210 provides a voltage to the output driver 220 indicating the output driver 220 should be less conductive, thereby driving the regulated output voltage 250 to a lower level.

However, this feedback mechanism can react relatively slowly to rapid changes in power demands from any power consumption circuitry (shown in FIG. 2 as a load 299) coupled to the regulated output voltage 250. Embodiments of the present disclosure use the variation detector 260 to provide a stable regulated output voltage 250 that reacts more quickly in response to rapid changes in power requirements from circuitry coupled to the regulated output voltage 250.

FIG. 3 is a schematic diagram of the voltage regulator 200 of FIG. 2 showing details for the amplifier 210 and the variation detector 260, along with graphs showing responses to a rapid change on the regulated output voltage 250 in the form of a drop in voltage.

Figure 4:
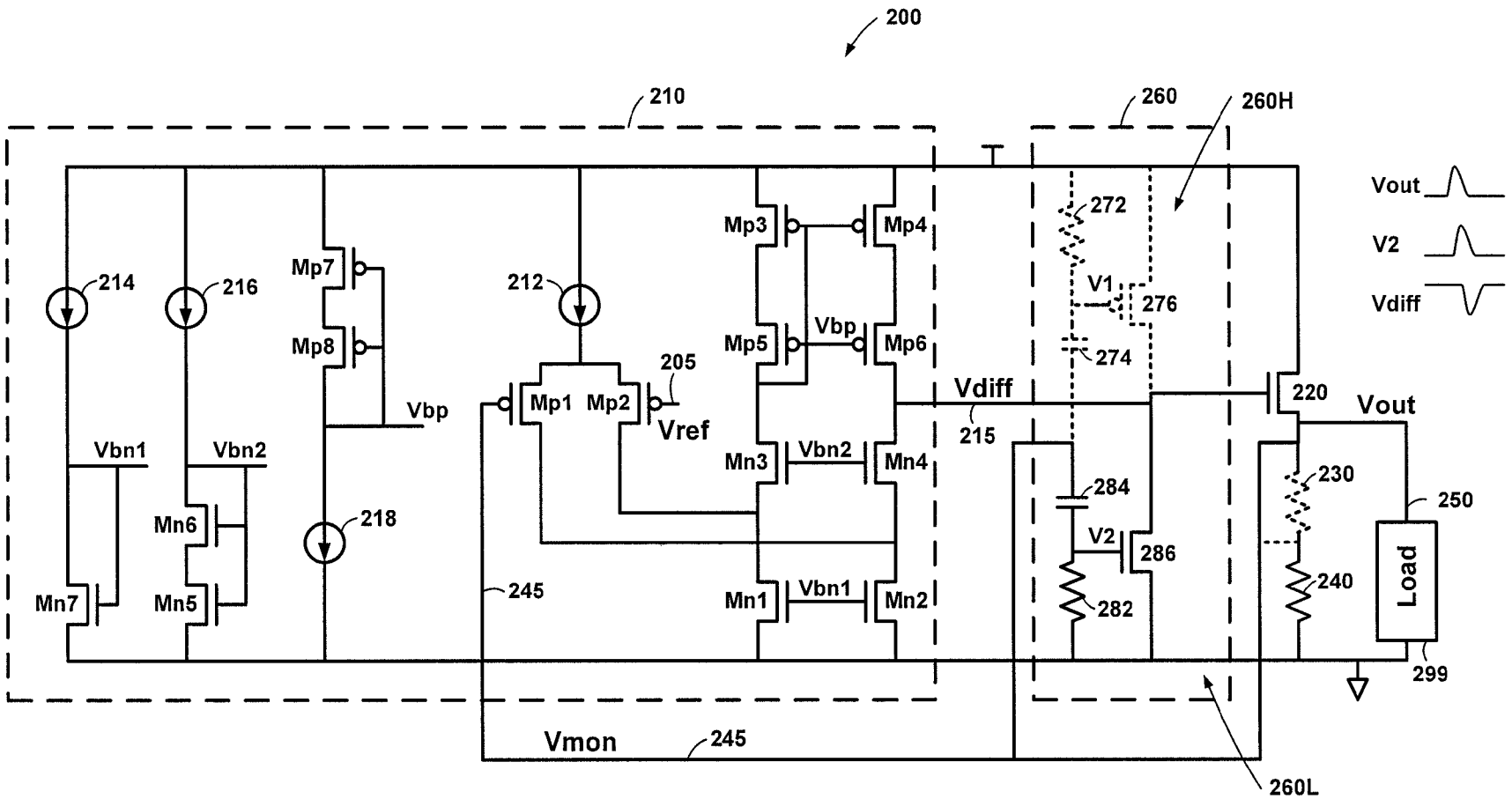
FIG. 4 is a schematic diagram of the voltage regulator of FIG. 2 showing details for the amplifier and the variation detector, along with graphs showing responses to a rapid change on the regulated output voltage in the form of a rise in voltage.

FIG. 4 is a schematic diagram of the voltage regulator 200 of FIG. 2 showing details for the amplifier 210 and the variation detector 260, along with graphs showing responses to a rapid change on the regulated output voltage 250 in the form of a rise in voltage.

FIGS. 3 and 4 are similar and will be described together with any differences pointed out as needed. The amplifier 210 is configured as an operational transconductance amplifier (OTA). The OTA includes a current source 212 for providing current to a differential pair of p-channel transistors (Mp1 and Mp2) with transistor Mp1 coupled to the feedback voltage 245 and transistor Mp2 coupled to the reference voltage 205.

Transistor Mp2 drives n-channel transistor Mn1 and transistor Mp1 drives n-channel transistor Mn2. The n-channel transistors Mn1 and Mn2 are respectively cascoded with n-channel transistors Mn3 and Mn4. On a pull-up side of the OTA, cascoded p-channel transistors Mp3 and Mp5 are coupled to n-channel transistor Mn3. Similarly, cascoded p-channel transistors Mp4 and Mp6 are coupled to n-channel transistor Mn4. The difference voltage 215 is driven from the stack of transistors Mp4, Mp6, Mn4, and Mn2. N-channel transistors Mn1 and Mn2 may be biased with a bias voltage Vbn1 generated by a current source 214 coupled in series with n-channel transistor Mn7. N-channel transistors Mn3 and Mn4 may be biased with a bias voltage Vbn2 generated by a current source 216 coupled in series with n-channel transistors Mn5 and Mn6. P-channel transistors Mp5 and Mp6 may be biased with a bias voltage Vbp generated by a current sink 218 coupled in series with p-channel transistors Mp7 and Mp8.

The output circuit including the output driver 220, the possible first resistance 230, the second resistance 240, the reference output voltage 250, and the load 299 are configured and operate in a manner similar to that described above with reference to FIG. 2.

The variation detector 260 may be thought of as a high-side variation detector 260H and a low-side variation detector 260L. For convenience of discussion, the high-side variation detector 260H is illustrated with solid lines in FIG. 3 and dashed lines in FIG. 4. Conversely, the low-side variation detector 260L is illustrated with solid lines in FIG. 4 and dashed lines in FIG. 3.

The high-side variation detector 260H includes a high-side capacitance 274 in series with a high-side resistance 272 between the feedback voltage 245 and a high power source (illustrated here as VDD). The coupling between the high-side capacitance 274 and the high-side resistance 272 drives a high-side sense signal V1, which is coupled to a gate of a p-channel transistor 276. The p-channel transistor 276 includes a source coupled to the high power source and a drain coupled to the difference voltage 215.

The low-side variation detector 260L includes a low-side capacitance 284 in series with a low-side resistance 282 between the feedback voltage 245 and a low power source (illustrated here as ground). The coupling between the low-side capacitance 284 and the low-side resistance 282 drives a low-side sense signal V2, which is coupled to a gate of an n-channel transistor 286. The n-channel transistor 286 includes a source coupled to the low power source and a drain coupled to the difference voltage 215.

The p-channel transistor 276 and the n-channel transistor 286 each may be referred to as a current source for supplying current onto the difference voltage 215.

In operation, the high-side variation detector 260H responds to rapid drops in voltage output on the regulated output voltage 250 as illustrated in the graphs in FIG. 3. As shown in the graph, the regulated output voltage 250 (Vout) decreases sharply due to a sharp change in current draw from the load 299. Due to the characteristic of the high-side capacitance 274 and the low-side capacitance 284, the voltages at the high-side sense signal V1 and the low-side sense signal V2 will drop when the regulated output voltage 250 suddenly decreases (only the high-side sense signal V1 is illustrated in the graph of FIG. 3). The voltage drop on the high-side sense signal V1 makes the gate-to-source voltage on the p-channel transistor 276 large enough to turn on the p-channel transistor 276, which charges the parasitic capacitance on the difference voltage 215 to pull it up. When the difference voltage 215 goes up, the output driver 220 supplies more current to the load 299 and rapidly pulls the regulated output voltage 250 back up. The voltage rise on the regulated output voltage 250 couples across the high-side capacitance 274 to pull the high-side sense signal V1 back high in combination with the high-side resistance 272. A high on the high-side sense signal V1 turns the p-channel transistor 276 back off.

On the low side, the low-side sense signal V2 also goes to a lower voltage caused by the capacitive coupling across the low-side capacitance 284 from the initial drop in voltage on the regulated output voltage 250. However, a lower voltage on the low-side sense signal V2 just makes the gate-to-source voltage on the n-channel transistor 286 even smaller and the n-channel transistor 286 remains off.

Referring to FIG. 4, the low-side variation detector 260L responds to rapid jumps in voltage output on the regulated output voltage 250. As shown in the graph, the regulated output voltage 250 (Vout) increases sharply due to a sharp change in current draw from the load 299. Due to the characteristic of the high-side capacitance 274 and the low-side capacitance 284, the voltages at the high-side sense signal V1 and the low-side sense signal V2 will rise when the regulated output voltage 250 suddenly increases (only the low-side sense signal V2 is illustrated in the graph of FIG. 4). The voltage rise on the low-side sense signal V2 makes the gate-to-source voltage on the n-channel transistor 286 large enough to turn on the n-channel transistor 286, which discharges the parasitic capacitance on the difference voltage 215 to pull it down. When the difference voltage 215 goes down, the output driver 220 supplies less current to the load 299, which rapidly pulls the regulated output voltage 250 back down. The voltage drop on the regulated output voltage 250 couples across the low-side capacitance 284 to pull the low-side sense signal V2 back down in combination with the low-side resistance 282. A low on the low-side sense signal V2 turns the n-channel transistor 286 back off.

On the high side, the high-side sense signal V1 also goes to a higher voltage caused by the capacitive coupling across the high-side capacitance 274 from the initial rise in voltage on the regulated output voltage 250. However, a higher voltage on the high-side sense signal V1 just makes the gate-to-source voltage on the p-channel transistor 276 even smaller and the p-channel transistor 276 remains off.

These rapid responses of the high-side variation detector 260H and the low-side variation detector 260L due to the capacitive coupling across the high-side capacitance 274 and the low-side capacitance 284, respectively, provide a much more rapid response than the larger feedback loop involving the amplifier 210. As a result, the difference voltage 215 and regulated output voltage 250 are pulled back to their desired levels much more quickly as is discussed more fully below in reference to FIGS. 6A and 6B.

In some embodiments, both the high-side variation detector 260H and the low-side variation detector 260L may be included. Other embodiments may include only the high-side variation detector 260H. Still other embodiments may include only the low-side variation detector 260L. For example, characteristics of the load 299 may be such that rapid drops in the regulated output voltage 250 are not likely to happen and there is little need for the high-side variation detector 260H. In other embodiments, characteristics of the load 299 may be such that rapid jumps in the regulated output voltage 250 are not likely to happen and there is little need for the low-side variation detector 260L.

Figure 5:
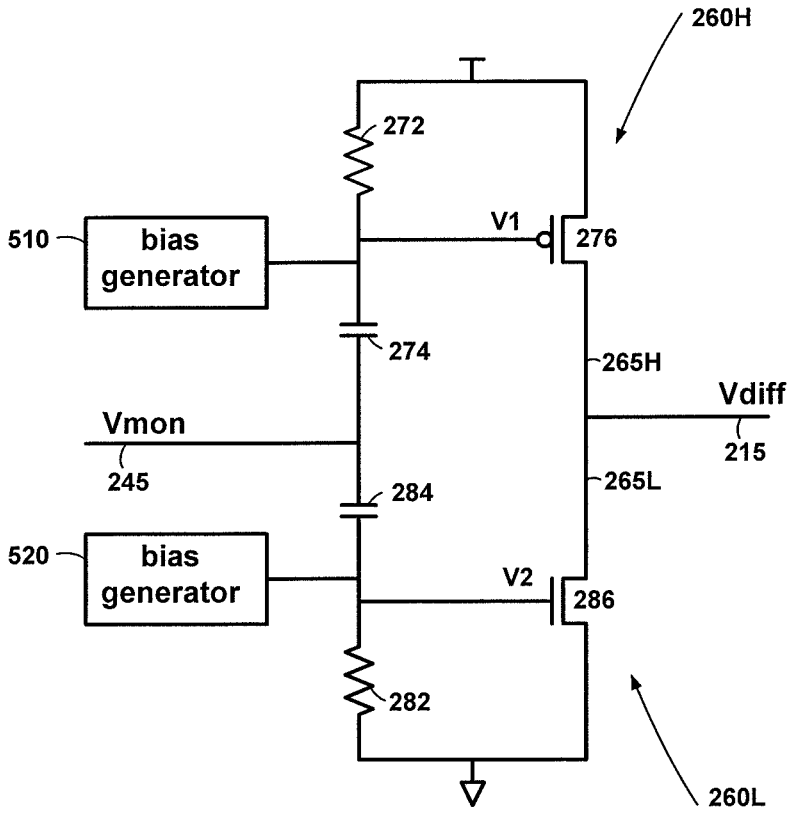
FIG. 5 is a schematic diagram illustrating the variation detector and bias generators that may be used in some embodiments of the present disclosure.

FIG. 5 is a schematic diagram illustrating the variation detector 260 and bias generators (510 and 520) that may be used in some embodiments of the present disclosure. The high-side capacitance 274, the high-side resistance 272, and the p-channel transistor 276 of the high-side variation detector 260H are the same as that of FIGS. 3 and 4 and need not be described again. Similarly, the low-side capacitance 284, the low-side resistance 282, and the n-channel transistor 286 of the low-side variation detector 260L are the same as that of FIGS. 3 and 4 and need not be described again.

However, a high-side bias generator 510 couples to the high-side sense signal V1 and a low-side bias generator 520 couples to the low-side sense signal V2. These bias generators may be configured to drive a small bias voltage on their respective signals to bring the gate-to-source voltage of the respective p-channel transistor 276 or n-channel transistor 286 closer to a turn-on voltage. As a result, even a smaller capacitive coupling from the feedback voltage 245 across the respective high-side capacitance 274 and low-side capacitance 284 is needed to turn on the appropriate transistor.

In addition, the combined impedance of the high-side capacitance 274 and the high-side resistance 272 may be referred to herein as a high-side impedance. Similarly, the combined impedance of the low-side capacitance 284 and the low-side resistance 282 may be referred to herein as a low-side impedance. In some embodiments, the low-side impedance may be set smaller than the high-side impedance. During power supply startup, this variation may hold the p-channel transistor 276 off while allowing the n-channel transistor 286 to conduct, which may avoid a possible overvoltage on the regulated output voltage 250 during startup.

Figure 6A:
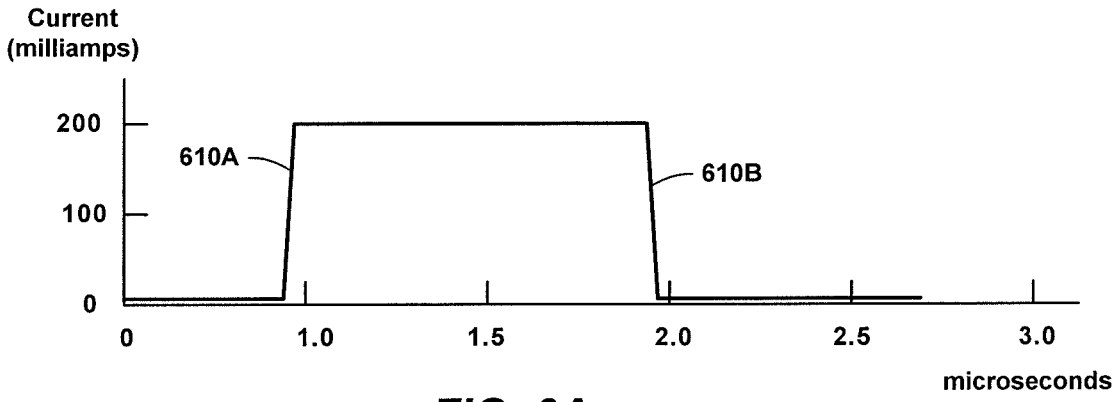
FIG. 6A is a graph showing an output current for the regulated output voltage.
Figure 6B:
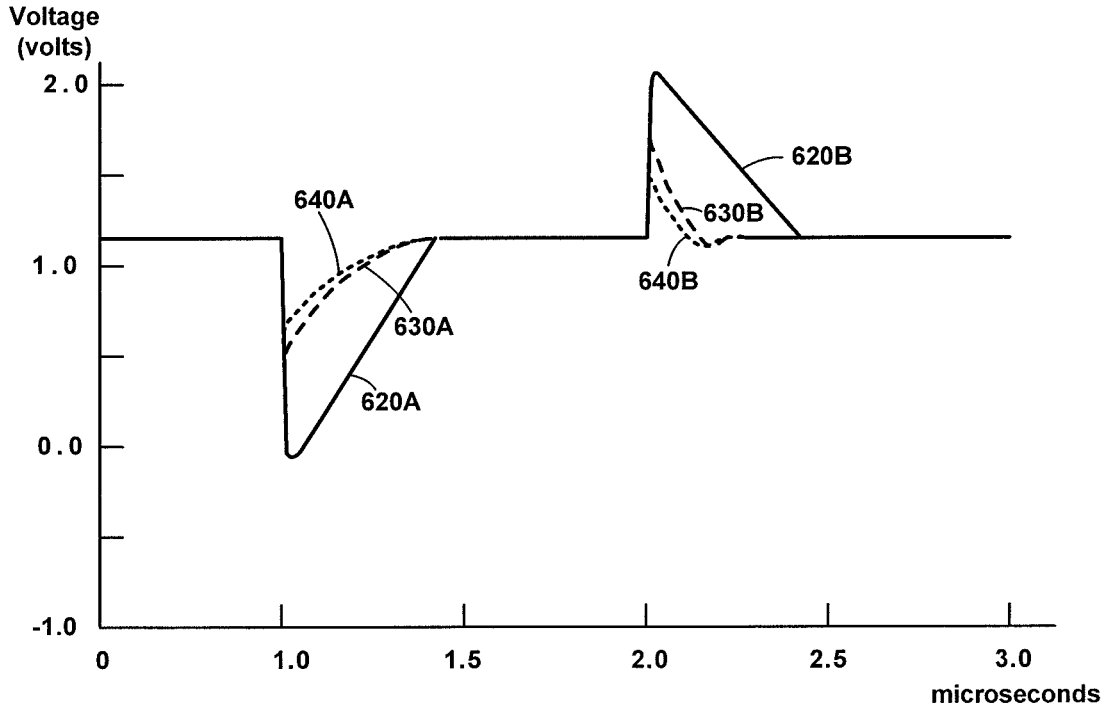
FIG. 6B is a graph showing various voltages for the signals of FIGS. 3-5 in response to changes in the output current for the regulated output voltage shown in FIG. 6A.

FIG. 6A is a graph showing an output current 610 for the regulated output voltage 250 of FIGS. 3-5. FIG. 6B is a graph showing various voltages for the regulated output voltage 250 of FIGS. 3-5 in various configurations and in response to changes in the output current 610 shown in FIG. 6A.

Reference will also be made, to FIGS. 2-5 while describing FIGS. 6A and 6B. Voltage curve 620 represents the regulated output voltage 250 of the voltage regulator 200 of FIGS. 2-4 without the variation detector 260. Voltage curve 630 represents the regulated output voltage 250 from the voltage regulator 200 according to embodiments of the present disclosure with the variation detector 260, but without the bias generators (510 and 520) of FIG. 5. Finally, voltage curve 640 represents the regulated output voltage 250 from the voltage regulator 200 according embodiments of the present disclosure with the variation detector 260 and the bias generators (510 and 520) of FIG. 5.

A sharp rise in output current 610A on the regulated output voltage 250 is illustrated in FIG. 6A. In FIG. 6B, curve 620A illustrates a sharp drop in the regulated output voltage 250 due to the sharp rise in output current 610A. A relatively slow response time of the regulated output voltage 250 is shown for the voltage regulator 200 without the variation detector 260 before the regulated output voltage 250 returns to the proper voltage level.

Curve 630A also illustrates a sharp drop in the regulated output voltage 250 due to the sharp rise in output current 610A. However, a much quicker response time on curve 630A indicates that the regulated output voltage 250 is being pulled higher more rapidly by the high-side variation detector 260H pulling the regulated output voltage 250 up before the overall feedback loop involving the amplifier 210 kicks in.

Curve 640A also illustrates a sharp drop in the regulated output voltage 250 due to the sharp rise in output current 610A. However, an even quicker response time on curve 640A indicates that the regulated output voltage 250 is being pulled higher more rapidly by the high-side variation detector 260H, which is biased to turn on more quickly, pulling the regulated output voltage 250 up before the overall feedback loop involving the amplifier 210 kicks in.

A sharp drop in output current 610B on the regulated output voltage 250 is illustrated in FIG. 6A. In FIG. 6B, curve 620B illustrates a sharp rise in the regulated output voltage 250 due to the sharp drop in output current 610B. A relatively slow response time of the regulated output voltage 250 is shown for voltage regulator 200 without the variation detector 260 before the regulated output voltage 150 returns to the proper voltage level.

Curve 630B also illustrates a sharp rise in the regulated output voltage 250 due to the sharp rise in output current 610B. However, a much quicker response time on curve 630B indicates that the regulated output voltage 250 is being pulled lower more rapidly by the low-side variation detector 260L pulling the regulated output voltage 250 down before the overall feedback loop involving the amplifier 210 kicks in.

Curve 640B also illustrates a sharp rise in the regulated output voltage 250 due to the sharp rise in output current 610B. However, an even quicker response time on curve 640B indicates that the regulated output voltage 250 is being pulled lower more rapidly by the low-side variation detector 260L, which is biased to turn on more quickly, pulling the regulated output voltage 250 down before the overall feedback loop involving the amplifier 210 kicks in.

While the present disclosure has been described herein with respect to certain illustrated embodiments, those of ordinary skill in the art will recognize and appreciate that the present invention is not so limited. Rather, many additions, deletions, and modifications to the illustrated and described embodiments may be made without departing from the scope of the invention as hereinafter claimed along with their legal equivalents. In addition, features from one embodiment may be combined with features of another embodiment while still being encompassed within the scope of the invention as contemplated by the inventor.

What is claimed is:

1. A voltage regulator, comprising:

an amplifier configured to generate a difference voltage responsive to a comparison of a reference voltage and a feedback voltage;

an output driver operably coupled to the amplifier and configured to drive a regulated output voltage responsive to the difference voltage;

an impedance circuit operably coupled between the output driver and a low power source and configured to establish the feedback voltage responsive to a current through the impedance circuit; and a variation detector operably coupled between the regulated output voltage and the difference voltage and configured to modify the difference voltage responsive to a rapid change of the regulated output voltage capacitively coupled to the variation detector, wherein the variation detector comprises:

a high-side variation detector, comprising:

a high-side capacitance operably coupled between the regulated output voltage and a high-side sense signal;

a high-side resistance operably coupled between a high power source and the high-side sense signal; and a p-channel transistor with a source operably coupled to the high power source, a drain operably coupled to the difference voltage, and a gate operably coupled to the high-side sense signal; and a low-side variation detector, comprising:

a low-side capacitance operably coupled between the regulated output voltage and a low-side sense signal;

a low-side resistance operably coupled between the low power source and the low-side sense signal; and an n-channel transistor with a source operably coupled to the low power source, a drain operably coupled to the difference voltage, and a gate operably coupled to the low-side sense signal.

2. The voltage regulator of claim 1, further comprising a high-side bias generator operably coupled to the high-side sense signal and configured to provide a voltage on the high-side sense signal between the high power source and a gate-to-source voltage of the p-channel transistor.

3. The voltage regulator of claim 1, further comprising a low-side bias generator operably coupled to the low-side sense signal and configured to provide a voltage on the low-side sense signal between the low power source and a gate-to-source voltage of the n-channel transistor.

4. The voltage regulator of claim 1, wherein a high-side impedance of a combination of the high-side capacitance and the high-side resistance is configured to be higher than a low-side impedance of a combination of the low-side capacitance and the low-side resistance.

5. A voltage regulator, comprising:

an amplifier configured to generate a difference voltage responsive to a comparison of a reference voltage and a feedback voltage;

an output driver operably coupled to the amplifier and configured to drive a regulated output voltage responsive to the difference voltage;

an impedance circuit operably coupled between the output driver and a low power source and configured to establish the feedback voltage responsive to a current through the impedance circuit; and a variation detector operably coupled between the regulated output voltage and the difference voltage and configured to modify the difference voltage responsive to a rapid change of the regulated output voltage capacitively coupled to the variation detector, wherein the variation detector comprises a high-side variation detector, comprising:

a high-side capacitance operably coupled between the regulated output voltage and a high-side sense signal;

a high-side resistance operably coupled between a high power source and the high-side sense signal; and a p-channel transistor with a source operably coupled to the high power source, a drain operably coupled to the difference voltage, and a gate operably coupled to the high-side sense signal.

6. The voltage regulator of claim 5, further comprising a high-side bias generator operably coupled to the high-side sense signal and configured to provide a voltage on the high-side sense signal between the high power source and a gate-to-source voltage of the p-channel transistor.

7. A voltage regulator, comprising:

an amplifier configured to generate a difference voltage responsive to a comparison of a reference voltage and a feedback voltage;

an output driver operably coupled to the amplifier and configured to drive a regulated output voltage responsive to the difference voltage;

an impedance circuit operably coupled between the output driver and a low power source and configured to establish the feedback voltage responsive to a current through the impedance circuit; and a variation detector operably coupled between the regulated output voltage and the difference voltage and configured to modify the difference voltage responsive to a rapid change of the regulated output voltage capacitively coupled to the variation detector, wherein the variation detector comprises a low-side variation detector, comprising:

a low-side capacitance operably coupled between the regulated output voltage and a low-side sense signal;

a low-side resistance operably coupled between the low power source and the low-side sense signal; and an n-channel transistor with a source operably coupled to the low power source, a drain operably coupled to the difference voltage, and a gate operably coupled to the low-side sense signal.

8. The voltage regulator of claim 7, further comprising a low-side bias generator operably coupled to the low-side sense signal and configured to provide a voltage on the low-side sense signal between the low power source and a gate-to-source voltage of the n-channel transistor.

9. A method of regulating voltage, comprising:

comparing a reference voltage and a feedback voltage to generate a difference voltage responsive to the comparing;

driving a regulated output voltage responsive to the difference voltage;

establishing the feedback voltage responsive to a current through an impedance circuit operably coupled between the regulated output voltage and a low power source; and modifying the difference voltage responsive to a rapid change of the regulated output voltage by:

capacitively coupling the regulated output voltage to a current source for providing current to the difference voltage during the rapid change;

detecting a high-side variation, comprising:

capacitively coupling the regulated output voltage to a high-side sense signal;

providing a resistance between the high-side sense signal and a high power source; and gating the high power source onto the difference voltage responsive to the high-side sense signal; and detecting a low-side variation, comprising:

capacitively coupling the regulated output voltage to a low-side sense signal;

providing a resistance between the low-side sense signal and the low power source; and gating the low power source onto the difference voltage responsive to the low-side sense signal.

10. The method of claim 9, further comprising providing a voltage on the high-side sense signal between the high power source and a gate-to-source voltage of a p-channel transistor configured to perform gating the high power source onto the difference voltage.

11. The method of claim 9, further comprising providing a voltage on the low-side sense signal between the low power source and a gate-to-source voltage of an n-channel transistor configured to perform gating the low power source onto the difference voltage.

12. A method of regulating voltage, comprising:

comparing a reference voltage and a feedback voltage to generate a difference voltage responsive to the comparing;

driving a regulated output voltage responsive to the difference voltage;

establishing the feedback voltage responsive to a current through an impedance circuit operably coupled between the regulated output voltage and a low power source; and modifying the difference voltage responsive to a rapid change of the regulated output voltage by:

capacitively coupling the regulated output voltage to a current source for providing current to the difference voltage during the rapid change;

capacitively coupling the regulated output voltage to a high-side sense signal;

providing a resistance between the high-side sense signal and a high power source; and gating the high power source onto the difference voltage responsive to the high-side sense signal.

13. The method of claim 12, further comprising providing a voltage on the high-side sense signal between the high power source and a gate-to-source voltage of a p-channel transistor configured to perform gating the high power source onto the difference voltage.

14. A method of regulating voltage, comprising:

comparing a reference voltage and a feedback voltage to generate a difference voltage responsive to the comparing;

driving a regulated output voltage responsive to the difference voltage;

establishing the feedback voltage responsive to a current through an impedance circuit operably coupled between the regulated output voltage and a low power source; and modifying the difference voltage responsive to a rapid change of the regulated output voltage by:

capacitively coupling the regulated output voltage to a current source for providing current to the difference voltage during the rapid change;

capacitively coupling the regulated output voltage to a low-side sense signal;

providing a resistance between the low-side sense signal and the low power source; and gating the low power source onto the difference voltage responsive to the low-side sense signal.

15. The method of claim 14, further comprising providing a voltage on the low-side sense signal between the low power source and a gate-to-source voltage of an n-channel transistor configured to perform gating the low power source onto the difference voltage.

16. A voltage regulator, comprising:

an amplifier configured to generate a difference voltage responsive to a comparison of a reference voltage and a feedback voltage;

an output driver operably coupled to the amplifier and configured to drive a regulated output voltage responsive to the difference voltage;

an impedance circuit operably coupled between the output driver and a low power source and configured to establish the feedback voltage responsive to a current through the impedance circuit; and a variation detector operably coupled between the feedback voltage and the difference voltage and configured to modify the difference voltage responsive to a rapid change of the feedback voltage capacitively coupled to the variation detector, wherein the variation detector comprises:

a high-side variation detector, comprising:

a high-side capacitance operably coupled between the feedback voltage and a high-side sense signal;

a high-side resistance operably coupled between a high power source and the high-side sense signal; and a p-channel transistor with a source operably coupled to the high power source, a drain operably coupled to the difference voltage, and a gate operably coupled to the high-side sense signal; and a low-side variation detector, comprising:

a low-side capacitance operably coupled between the feedback voltage and a low-side sense signal;

a low-side resistance operably coupled between the low power source and the low-side sense signal; and an n-channel transistor with a source operably coupled to the low power source, a drain operably coupled to the difference voltage, and a gate operably coupled to the low-side sense signal.

17. The voltage regulator of claim 16, further comprising a high-side bias generator operably coupled to the high-side sense signal and configured to provide a voltage on the high-side sense signal between the high power source and a gate-to-source voltage of the p-channel transistor.

18. The voltage regulator of claim 16, further comprising a low-side bias generator operably coupled to the low-side sense signal and configured to provide a voltage on the low-side sense signal between the low power source and a gate-to-source voltage of the n-channel transistor.

19. A voltage regulator, comprising:

an amplifier configured to generate a difference voltage responsive to a comparison of a reference voltage and a feedback voltage;

an output driver operably coupled to the amplifier and configured to drive a regulated output voltage responsive to the difference voltage;

an impedance circuit operably coupled between the output driver and a low power source and configured to establish the feedback voltage responsive to a current through the impedance circuit; and a variation detector operably coupled between the feedback voltage and the difference voltage and configured to modify the difference voltage responsive to a rapid change of the feedback voltage capacitively coupled to the variation detector, wherein a high-side impedance of a combination of the high-side capacitance and the high-side resistance is configured to be higher than a low-side impedance of a combination of the low-side capacitance and the low-side resistance.

20. A voltage regulator, comprising:

an amplifier configured to generate a difference voltage responsive to a comparison of a reference voltage and a feedback voltage;

an output driver operably coupled to the amplifier and configured to drive a regulated output voltage responsive to the difference voltage;

an impedance circuit operably coupled between the output driver and a low power source and configured to establish the feedback voltage responsive to a current through the impedance circuit; and a variation detector operably coupled between the feedback voltage and the difference voltage and configured to modify the difference voltage responsive to a rapid change of the feedback voltage capacitively coupled to the variation detector, wherein the variation detector comprises a high-side variation detector, comprising:

a high-side capacitance operably coupled between the feedback voltage and a high-side sense signal;

a high-side resistance operably coupled between a high power source and the high-side sense signal; and a p-channel transistor with a source operably coupled to the high power source, a drain operably coupled to the difference voltage, and a gate operably coupled to the high-side sense signal.

21. A voltage regulator, comprising:

an amplifier configured to generate a difference voltage responsive to a comparison of a reference voltage and a feedback voltage;

an output driver operably coupled to the amplifier and configured to drive a regulated output voltage responsive to the difference voltage;

an impedance circuit operably coupled between the output driver and a low power source and configured to establish the feedback voltage responsive to a current through the impedance circuit; and a variation detector operably coupled between the feedback voltage and the difference voltage and configured to modify the difference voltage responsive to a rapid change of the feedback voltage capacitively coupled to the variation detector, wherein the variation detector comprises a low-side variation detector, comprising:

a low-side capacitance operably coupled between the feedback voltage and a low-side sense signal;

a low-side resistance operably coupled between the low power source and the low-side sense signal; and an n-channel transistor with a source operably coupled to the low power source, a drain operably coupled to the difference voltage, and a gate operably coupled to the low-side sense signal.

22. A method of regulating voltage, comprising:

comparing a reference voltage and a feedback voltage to generate a difference voltage responsive to the comparing;

driving a regulated output voltage responsive to the difference voltage;

establishing the feedback voltage responsive to a current through an impedance circuit operably coupled between the regulated output voltage and a low power source; and modifying the difference voltage responsive to a rapid change of the feedback voltage by:

capacitively coupling the feedback voltage to a current source for providing current to the difference voltage during the rapid change;

detecting a high-side variation, comprising:

capacitively coupling the feedback voltage to a high-side sense signal;

providing a resistance between the high-side sense signal and a high power source; and gating the high power source onto the difference voltage responsive to the high-side sense signal; and detecting a low-side variation, comprising:

capacitively coupling the feedback voltage to a low-side sense signal;

providing a resistance between the low-side sense signal and the low power source; and gating the low power source onto the difference voltage responsive to the low-side sense signal.

23. The method of claim 22, further comprising providing a voltage on the high-side sense signal between the high power source and a gate-to-source voltage of a p-channel transistor configured to perform gating the high power source onto the difference voltage.

24. The method of claim 22, further comprising providing a voltage on the low-side sense signal between the low power source and a gate-to-source voltage of an n-channel transistor configured to perform gating the low power source onto the difference voltage.

25. A method of regulating voltage, comprising:

comparing a reference voltage and a feedback voltage to generate a difference voltage responsive to the comparing;

driving a regulated output voltage responsive to the difference voltage;

establishing the feedback voltage responsive to a current through an impedance circuit operably coupled between the regulated output voltage and a low power source; and modifying the difference voltage responsive to a rapid change of the feedback voltage by:

capacitively coupling the feedback voltage to a current source for providing current to the difference voltage during the rapid change;

capacitively coupling the feedback voltage to a high-side sense signal;

providing a resistance between the high-side sense signal and a high power source; and gating the high power source onto the difference voltage responsive to the high-side sense signal.

26. A method of regulating voltage, comprising:

comparing a reference voltage and a feedback voltage to generate a difference voltage responsive to the comparing;

driving a regulated output voltage responsive to the difference voltage;

establishing the feedback voltage responsive to a current through an impedance circuit operably coupled between the regulated output voltage and a low power source; and modifying the difference voltage responsive to a rapid change of the feedback voltage by:

capacitively coupling the feedback voltage to a current source for providing current to the difference voltage during the rapid change;

capacitively coupling the feedback voltage to a low-side sense signal;

providing a resistance between the low-side sense signal and the low power source; and gating the low power source onto the difference voltage responsive to the low-side sense signal.

* * * * *